US009740120B1

(12) United States Patent
Saito et al.

(10) Patent No.: US 9,740,120 B1
(45) Date of Patent: Aug. 22, 2017

(54) ELECTROSTATIC CHARGE IMAGE DEVELOPING TONER, ELECTROSTATIC IMAGE DEVELOPER, AND TONER CARTRIDGE

(71) Applicant: FUJI XEROX CO., LTD., Tokyo (JP)

(72) Inventors: Yutaka Saito, Kanagawa (JP); Fusako Kiyono, Kanagawa (JP); Mona Tasaki, Kanagawa (JP); Hiroki Omori, Kanagawa (JP); Yuka Yamagishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/223,606

(22) Filed: Jul. 29, 2016

(30) Foreign Application Priority Data

Feb. 19, 2016 (JP) ..... 2016-029982

(51) Int. Cl.
*G03G 9/08* (2006.01)
*G03G 15/08* (2006.01)
*G03G 9/097* (2006.01)

(52) U.S. Cl.
CPC ..... *G03G 9/0819* (2013.01); *G03G 9/09708* (2013.01); *G03G 15/0865* (2013.01)

(58) Field of Classification Search
CPC ..... G03G 9/0819; G03G 9/09708
See application file for complete search history.

(56) References Cited

U.S. PATENT DOCUMENTS 5,712,073 A 1/1998 Katada et al.

FOREIGN PATENT DOCUMENTS

JP 3262505 B2 3/2002
JP 2006-285145 A 10/2006

*Primary Examiner* — Mark A Chapman
(74) *Attorney, Agent, or Firm* — Oliff PLC

(57) ABSTRACT

An electrostatic charge image developing toner includes toner particles, polishing agent particles which have a number particle size distribution having two peaks, and fatty acid metal salt particles which have a number particle size distribution having one peak, wherein the toner satisfies relationships expressed by expressions: (1) $Da \leq 0.5 \times Dt$, (2) $Dc \leq 0.5 \times Dt$ and (3) $Dt \leq Db$, wherein Da represents a particle diameter of a small-diameter-side peak in the two peaks of the number particle size distribution of the polishing agent particles, Db represents a particle diameter of a large-diameter-side peak in the two peaks of the number particle size distribution of the polishing agent particles, Dc represents a particle diameter of a peak of the number particle size distribution of the fatty acid metal salt particles, and Dt represents a volume average particle diameter of the toner particles.

8 Claims, 2 Drawing Sheets

ELECTROSTATIC CHARGE IMAGE DEVELOPING TONER, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2016-029982 filed Feb. 19, 2016.

BACKGROUND

1. Technical Field

The present invention relates to an electrostatic charge image developing toner, an electrostatic image developer, and a toner cartridge.

2. Related Art

In image formation by electrostatic photography, toner is used as an image forming material, for example, toner including toner particles, which contain a binder resin and a coloring agent, and an external additive to be externally added to the toner particles, is often used.

SUMMARY

According to an aspect of the invention, there is provided an electrostatic charge image developing toner including:

toner particles;

polishing agent particles which have a number particle size distribution having two peaks; and fatty acid metal salt particles which have a number particle size distribution having one peak;

wherein the toner satisfies relationships expressed by Expressions (1) to (3) below:

$$Da \leq 0.5 \times Dt \quad (1)$$

$$Dc \leq 0.5 \times Dt \quad (2)$$

$$Dt \leq Db \quad (3)$$

wherein Da represents a particle diameter of a small-diameter-side peak in the two peaks of the number particle size distribution of the polishing agent particles, Db represents a particle diameter of a large-diameter-side peak in the two peaks of the number particle size distribution of the polishing agent particles, Dc represents a particle diameter of a peak of the number particle size distribution of the fatty acid metal salt particles, and Dt represents a volume average particle diameter of the toner particles.

BRIEF DESCRIPTION OF THE DRAWINGS

Exemplary embodiments of the present invention will be described in detail based on the following figures, wherein.

DETAILED DESCRIPTION

Figure 1:
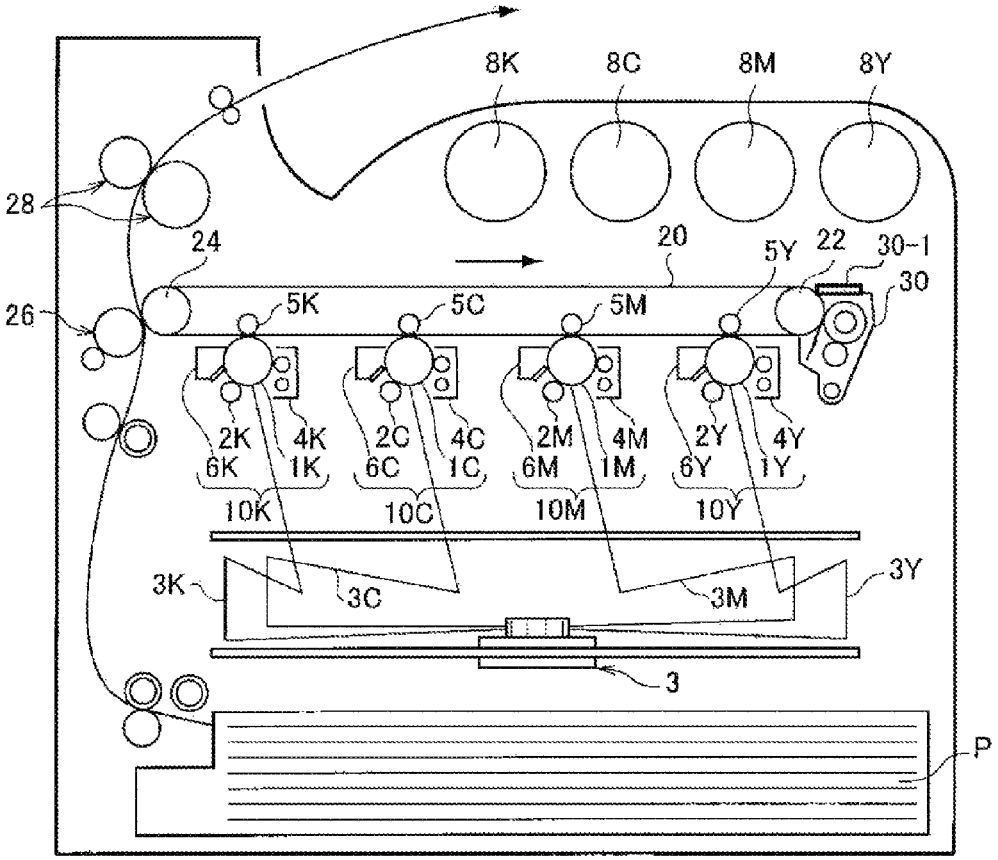
FIG. 1 is a schematic configuration diagram which shows an image forming apparatus according to an exemplary embodiment.

Description will be given below of the present invention by illustrating an exemplary embodiment as an example.

Electrostatic Charge Image Developing Toner

The electrostatic charge image developing toner (simply referred to as "toner") according to the exemplary embodiment has toner particles, polishing agent particles which have a number particle size distribution having two peaks, and fatty acid metal salt particles which have a number particle size distribution having one peak.

In the two peaks of the number particle size distribution of the polishing agent particles, when a particle diameter (referred to below as the "small-diameter-side particle diameter of the polishing agent particles") of the small-diameter-side peak is set as Da, a particle diameter (referred to below as the "large-diameter-side particle diameter of the polishing agent particles") of the large-diameter-side peak is set as Db, a particle diameter (referred to below as the "particle diameter of the fatty acid metal salt particles") of one peak of the number particle size distribution of the fatty acid metal salt particles is set as Dc, and a volume average particle diameter (referred to below as the "particle diameter of the toner particles") of the toner particles is set as Dt, the relationships in Expressions (1) to (3) below are satisfied.

$$Da \leq 0.5 \times Dt \quad \text{Expression (1):}$$

$$Dc \leq 0.5 \times Dt \quad \text{Expression (2):}$$

$$Dt \leq Db \quad \text{Expression (3):}$$

With the configuration described above, the toner according to the exemplary embodiment prevents the occurrence of toner scattering in an image portion and the occurrence of streaky image defects in a non-image portion, which may be caused when the output of images having the same image density is continued in an intermediate transfer-type image forming apparatus. The reason is considered to be as follows.

In the related art, an intermediate transfer-type image forming apparatus is known which, after the primary transfer of a toner image formed on the surface of an image holding member onto an intermediate transfer member, carries out secondary transfer of a toner image primary-transferred onto the intermediate transfer member onto a recording medium. A cleaning blade which cleans the surface of the intermediate transfer member after the secondary transfer may be provided in the intermediate transfer-type image forming apparatus.

In a case where a cleaning blade which cleans the surface of the image holding member is provided, a free external additive which is isolated from the toner is dammed in a leading end (site on the downstream side in the rotation direction of the image holding member) of a contact portion (referred to below as the "image holding member cleaning portion") between the cleaning blade and the image holding member, and aggregates (also referred to below as "external additive dams") aggregated by pressure from the cleaning blades are formed. The external additive dams contribute to the improvement of the cleaning property.

In a case where a cleaning blade is provided on the surface of the intermediate transfer member, a free external additive is not easily moved to the intermediate transfer member, and the amount which reaches the leading end (site on the downstream side in the rotation direction of the intermediate transfer member) of a contact portion (referred to below as a "intermediate transfer member cleaning portion") between the cleaning blade and the intermediate transfer member is reduced.

For this reason, when fatty acid metal salt particles having a smaller particle diameter than the toner particles are included in the toner, the fatty acid metal salt particles circulate with the toner particles (in a state of being attached to the toner particles and not easily isolated), are transferred along with the toner particles to the surface of the intermediate transfer member, and tend to remain in the transferred residual toner after the secondary transfer. Due to this, the fatty acid metal salt particles reach the leading end of the intermediate transfer member cleaning portion and form accumulations (referred to below as "fatty acid metal salt dams") of fatty acid metal salt particles. Due to the fatty acid metal salt dams, the cleaning property of the intermediate transfer member is improved.

On the other hand, due to the fatty acid metal salt particles in the fatty acid metal salt dam, a coated film of fatty acid metal salt is formed on the surface of the intermediate transfer member and the friction coefficient of the surface of the intermediate transfer member may be decreased. When the friction coefficient of the intermediate transfer member surface is decreased, toner may scatter from the toner layer forming the transferred toner image. In particular, in a case where a multi-layer toner image is transferred onto the intermediate transfer member, the toner layer of the lower layer is moved and the toner easily scatters.

In order to prevent the scattering of the toner, it is effective to include the polishing agent particles along with the fatty acid metal salt particle in the toner. When the polishing agent particles are included in the toner, the coating film of fatty acid metal salt formed on the surface of the intermediate transfer member is removed by the polishing agent particles and the scattering of toner is prevented.

However, in a case where the output of images with the same image density is continued, a high polishing force is required in the image portion on the intermediate transfer member since a coating film of fatty acid metal salt is easily formed, in contrast, a low polishing force is required in the non-image portion on the intermediate transfer member since a coating film of fatty acid metal salt is not easily formed. For this reason, in the image portion on the intermediate transfer member, when polishing agent particles are included in the toner such that the polishing force enough to remove the coating film of fatty acid metal salt is applied, the intermediate transfer member is excessively worn in the non-image portion on the intermediate transfer member and streaky image defects are caused, while, in the non-image portion on the intermediate transfer member, when polishing agent particles are included in the toner such that the intermediate transfer member is not excessively worn, the coating film of fatty acid metal salt is not easily removed in the image portion on the intermediate transfer member and toner scattering is easily caused.

In contrast, the toner according to the exemplary embodiment is formed to have toner particles, polishing agent particles which have a number particle size distribution having two peaks, and fatty acid metal salt particles which have a number particle size distribution having one peak, each of the particle diameters of the toner particles, polishing agent particles, and fatty acid metal salt particles satisfies the relationships in Expressions (1) to (3) below.

First, by satisfying the Expression (2), in other words, by setting the particle diameter Dc of the fatty acid metal salt particles to half or less the particle diameter of the toner particles, the fatty acid metal salt particles circulate particularly easily with the toner particles (easily enter a state of being attached to the toner particles and not being easily isolated). Due to this, the fatty acid metal salt particles are transferred to the surface of the intermediate transfer member with the toner particles, reach the leading end of the intermediate transfer member cleaning portion, and the tendency for fatty acid metal salt dams to be formed is increased. Due to the fatty acid metal salt dams, the cleaning property of the intermediate transfer member is improved.

Next, by satisfying the Expression (1), in other words, by setting the small-diameter side particle diameter Da of the polishing agent particles to half or less the particle diameter of the toner particles, the small-diameter side polishing agent particles circulate particularly easily with the toner particles (easily enter a state of being attached to the toner particles and not being easily isolated). Due to this, the polishing agent particles are transferred to the surface of the intermediate transfer member with the toner particles, and easily reach the intermediate transfer member cleaning portion. In other words, in the image portion on the intermediate transfer member, the small-diameter side polishing agent particles easily reach the intermediate transfer member cleaning portion. Since the small-diameter side polishing agent particles have small particle diameters, the polishing agent particles permeate up to the leading end of the intermediate transfer member cleaning portion, are strongly pressed to the cleaning blade, and apply a high polishing force. Due to this, even when the output of images with the same image density is continued, a high polishing force is applied by the small-diameter side polishing agent particles only in the image portion where the fatty acid metal salt coating film is easily formed, and the fatty acid metal salt coating film is easily removed.

Next, by satisfying the Expression (3), in other words, by setting the large-diameter side particle diameter Db of the polishing agent particles to be the same as the particle diameter of the toner particle or larger than the particle diameter of the toner particles, the large-diameter side polishing agent particles are easily isolated from the toner particles. The isolated large-diameter side polishing agent particles have a large particle diameter in addition to an electrostatic effect and the non-electrostatic adhesion force is weak, thus, the polishing agent particles move to the non-image portion on the image holding member due to the centrifugal force of the rotation of the developing electric field and the developing member, and the polishing agent particles are also easily moved to the non-image portion on the intermediate transfer member due to the centrifugal force of the rotation of the transfer electric field and the image holding member. In other words, in the non-image portion on the intermediate transfer member, the large-diameter side polishing agent particles easily reach the intermediate transfer member cleaning portion. Since the large-diameter side of the polishing agent particles have a large particle diameter, the polishing agent particles do not easily permeate up to the leading end of the intermediate transfer member cleaning portion, the pressing by the cleaning blade is weak, and only a low polishing force is applied. Due to this, even when the output of images with the same image density is continued, a high polishing force is not applied in the non-image portion where the fatty acid metal salt coating film is not easily formed, and excessive wear in the intermediate transfer member is prevented.

From the above, it is presumed the toner according to the exemplary embodiment prevents the occurrence of toner scattering in an image portion and the occurrence of streaky image defects in a non-image portion, which may be caused when the output of images with the same image density is continued in an intermediate transfer-type image forming apparatus.

In the toner according to the exemplary embodiment, each of the particle diameters Da, Db, Dc, and Dt of the polishing agent particles, the fatty acid metal salt particles, and the toner particles preferably satisfy the relationships in the following Expression (1-2) to Expression (3-2) from the point of view of preventing the occurrence of toner scattering in an image portion and the occurrence of streaky image defects in a non-image portion.

$$Da \leq 0.3 \times Dt \quad \text{Expression (1-2):}$$

$$Dc \leq 0.4 \times Dt \quad \text{Expression (2-2):}$$

$$Dt \leq 0.7 \times Db \quad \text{Expression (3-2):}$$

In addition, from the point of view of preventing the occurrence of toner scattering in an image portion and the occurrence of streaky image defects in a non-image portion, each of the particle diameters Da, Db, Dc, and Dt of the polishing agent particles, the fatty acid metal salt particles, and the toner particles is preferably in the following ranges.

Small side particle diameter Da of polishing agent particles: 0.3 μm to 4.0 μm (preferably 0.3 μm to 2.5 μm)

Large side particle diameter Db of polishing agent particles: 4.0 μm to 20 μm (preferably 5.0 μm to 15 μm)

Particle diameter Dc of fatty acid metal salt particles: 0.1 μm to 5.0 μm (preferably 0.5 μm to 3 μm)

Particle diameter Dt of toner particles: 3.0 μm to 10.0 μm (preferably 3.5 μm to 7.0 μm)

A number particle size distribution of the polishing agent particles having two peaks has the meaning of having at least a first peak where the frequency is the highest, a second peak where the frequency is the highest other than the first peak in the particle size distribution based on the number of the polishing agent particles. The first peak and the second peak may be the same frequency. The number particle size distribution of the polishing agent particles may have one or plural other peaks where the frequency is smaller than the first peak and the second peak. The polishing agent particles where the number particle size distribution has two peaks are, for example, obtained by preparing and mixing polishing agent particles with different number average particle diameters. The polishing agent particles with different number average particle diameters may be of different types. That is, the small-diameter side polishing agent particles and the large-diameter side polishing agent particles may be of different types.

In addition, the number particle size distribution of the fatty acid metal salt particles having one peak has the meaning of having at least a peak where the frequency is highest in the particle size distribution based on the number of the fatty acid metal salt particles. The number particle size distribution of the polishing agent particles may have one or plural peaks where the frequency is lower than the peak where the frequency is highest.

Each particle of the polishing agent particles and the fatty acid metal salt particles (the particle diameters of each peak) shows the particle diameters at the peak apex.

The number particle diameter distribution of the polishing agent particles and the fatty acid metal salt particles and each of the particle diameters Da, Db, and Dc are measured using the methods shown below.

First, the polishing agent particles and the fatty acid metal salt particles externally added to the toner particles which are the measurement target are observed using a scanning electron microscope (SEM). By image analysis, circle equivalent diameters of 100 of each of the polishing agent particles and the fatty acid metal salt particles which are the measurement targets are determined and the particle size distributions based on the numbers thereof are determined. Each of the particle diameters Da, Db, and Dc of the polishing agent particles and the fatty acid metal salt particles are determined from the obtained particle size distribution based on number.

In the image analysis to determine the equivalent circle diameter of 100 particles which are the measurement target, a two-dimensional image with a magnification of 10,000 is imaged using an analysis apparatus (ERA-8900: ELIONIX INC.) and, using image analysis software WINROOF (MITANI CORP.), a projected area is determined with a condition of 0.010000 μm/pixel, and the circle equivalent diameter is determined with the formula: circle equivalent diameter=2√(projected area/π).

The distinction between the fatty acid metal salt particles, the polishing agent particles, and other external additives is performed using the following method. The toner is dispersed by stirring after adding a surfactant to an aqueous solution adjusted to a specific gravity of 1.5 to 2.0 by dissolving in potassium iodide or the like. After that, by leaving the dispersion solution for 24 hours, the toner and the fatty acid metal salt particles where the specific gravity is lighter than the aqueous solution are separated to the upper part on the aqueous solution and the polishing agent where the specific gravity is heavier than the aqueous solution is precipitated to the lower part of the aqueous solution. The toner particles and the fatty acid metal salt particles separated to the upper part are removed, and a sample dried at room temperature (25° C.) is observed with an SEM, and the particles of 0.1 μm or more other than the toner particles are set as the fatty acid metal salt particles. In addition, the remaining aqueous solution is removed by heating at approximately 50° C. and the remaining particles are set as polishing agent particles. Through these processes, it is possible to determine Da, Db, and Dc of the separated particles using the observation unit described above.

In addition, in a case where the polishing agent particles and the fatty acid metal salt particles are obtained or taken from the toner separately, the obtained or taken polishing agent particles and fatty acid metal salt particles are set as measurement targets and the measurement described above is performed.

On the other hand, the particle diameter Dt of the toner particles is measured using the COULTER MULTISIZER II (manufactured by BECKMAN COULTER, INC.), and ISOTON-II (manufactured by BECKMAN COULTER, INC.) is used as the electrolytic solution.

At the time of measuring, 0.5 mg to 50 mg of measurement samples are added into 2 ml of a 5% aqueous solution of a surfactant (sodium alkylbenzenesulfonate is preferable) as a dispersing agent. The resultant is added into 100 ml to 150 ml of the electrolyte solution.

The electrolyte solution in which the sample is suspended is subjected to 1 minute dispersion treatment with an ultrasonic disperser, the particle size distribution of the particles with a particle diameter in the range of 2 μm to 60 μm is measured using an aperture of 100 μm as an aperture diameter using the COULTER MULTISIZER II. The number of sampled particles is 50,000.

With respect to the particle size range (channel) divided based on the measured particle size distribution, a cumulative distribution of the volume is depicted from the small-diameter side, the particle diameter which is cumulative 50% is defined as the volume average particle diameter Dt (=D50v).

In a case of measuring from the toner, for example, the particle diameter measurement described above is performed after removing external additives (polishing agent particles, fatty acid metal salt particles, and other external additives) attached to or isolated from the surface by carrying out an ultrasonic treatment (20 kHz, 10 minutes) in water with respect to the toner.

In the toner according to the exemplary embodiment, it is preferable that the ratio of the toner particles where the fatty acid metal salt particles are attached to the surface (also referred to below as the "ratio of the fatty acid metal salt-attached toner particles") is 30% by number to 90% by number of all of the toner particles and, among the fatty acid metal salt particles attached to the surface of the toner particles, the ratio (referred to below as the "ratio of strongly attached fatty acid metal salt particles") of the fatty acid metal salt particles strongly attached to the surface of the toner particles is 50% by number or more.

When the ratio of the fatty acid metal salt-attached toner particles and the ratio of strongly attached fatty acid metal salt particles are set to the ranges described above, the fatty acid metal salt particles circulate particularly easily with the toner particles (easily enter a state of being attached to the toner particles and not being easily isolated). Due to this, the fatty acid metal salt particles are transferred to the surface of the intermediate transfer member with the toner particles and reach the leading end of the intermediate transfer member cleaning portion, and the tendency to form fatty acid metal salt dams is further increased. Due to the fatty acid metal salt dams, the cleaning property of the intermediate transfer member is improved. Even in this aspect, due to each of the particle diameters of the toner particles, the polishing agent particles, and the fatty acid metal salt particles satisfying the relationships in Expression (1) to Expression (3), it is easier to prevent the occurrence of toner scattering in an image portion and the occurrence of streaky image defects in a non-image portion.

The ratio of the fatty acid metal salt-attached toner particles (the ratio of the toner particles to which the fatty acid metal salt particles are attached to the surface) is 30% by number of all of the toner particles; however, from the point of view of improving the cleaning property of the intermediate transfer member, 35% by number or more is preferable, and 40% by number or more is more preferable. The ratio of the fatty acid metal salt-attached toner particles is preferably 90% by number or less from the point of view of restrictions on the preparation method on one hand, while 70% by number or less is preferable, and 60% by number or less is more preferable from the point of view of forming an appropriate fatty acid metal salt coating film.

The ratio of strongly attached fatty acid metal salt particles (the ratio of the fatty acid metal salt particles which are strongly attached to the surface of the toner particles among the fatty acid metal salt particles which are attached to the surface of the toner particles) is 50% by number; however, from the point of view of improving the cleaning property of the intermediate transfer member, 55% by number or more is preferable, and 60% by number or more is more preferable. The upper limit of the ratio of strongly attached fatty acid metal salt particles is not particularly limited; however, from the point of view of forming an appropriate fatty acid metal salt coating film, the ratio of strongly attached fatty acid metal salt particles may be 90% by number or less.

Examples of the method for setting the ratio of fatty acid metal salt-attached toner particles and the ratio of the strongly attached fatty acid metal salt particles to the ranges described above include a method for attaching the fatty acid metal salt particles to the toner particle surface using shear force. This method is preferable due to the small mechanical load on the toner particles and the strong attachment of the fatty acid metal salt particles. Examples of apparatus used in this method include NOBIRUTA (for example, NOBIRUTANOB130: manufactured by HOSOKAWA MICRON LTD, or the like). NOBIRUTA is a stirring apparatus for stirring while applying a high pressure to particles by narrowing the free space (clearance) for inserting the particles. In NOBIRUTA, according to the clearance and stirring rotation speed, the ratio of the fatty acid metal salt-attached toner particles and the ratio of strongly attached fatty acid metal salt particles are adjusted.

Other examples of the method for setting the ratio of fatty acid metal salt-attached toner particles and the ratio of the strongly attached fatty acid metal salt particles to the ranges described above also include a method for strengthening the attachment force of the external additive to the surface of the toner particles by heating the toner after the external addition.

The ratio of fatty acid metal salt-attached toner particles and the ratio of the strongly attached fatty acid metal salt particles are values measured using the methods shown below.

First, the next first pre-treatment is carried out on the toner which is the measurement target.

10 g of the toner is dispersed in 40 ml of an aqueous solution with 0.2% by weight of a surfactant. The resultant is stirred for 30 seconds at 500 rpm using a magnetic stirrer and a stirrer. After that, after removing the supernatant liquid by separating the toner under conditions of 10,000 rpm×2 minutes in a centrifuge with a 50 ml settling tube, a first pre-treated toner is obtained by drying for 24 hours at room temperature (25° C.).

Next, using the first pre-treated toner, the ratio of the fatty acid metal salt-attached toner particles is measured using the method shown below. In the following observation of the first pre-treated toner, toner particles which are observed to be in contact with or overlapping the fatty acid metal salt particles are regarded as toner particles to which the fatty acid metal salt particles are attached.

100 particles of the toner which is the measurement target are observed using a scanning electron microscope (SEM). The ratio of toner where the fatty acid metal salt is attached to the toner surface is calculated. The SEM observation of 100 particles which are the measurement target is performed using ERA-8900: manufactured by ELIONIX INC.

On the other hand, the ratio of the strongly attached fatty acid metal salt particles is measured using the method shown below using the first pre-treated toner.

With respect to the first pre-treated toner, a second pre-treatment is performed excluding the weakly attached fatty acid metal salt particles. After dispersing 10 g of the toner in 40 ml of an aqueous solution with 0.2% by weight of a surfactant, ultrasonic vibration with an output of 60 W and a frequency of 20 kHz is applied for one hour using an ULTRASONIC HOMOGENIZER US300T (manufactured by NISSEI CORP.). After that, after removing the supernatant liquid by separating the toner under conditions of 10,000 rpm×2 minutes in a centrifuge with a 50 mL settling tube, the second pre-treated toner is obtained by drying for 24 hours at room temperature (25° C.).

Fluorescent X-ray measurement is carried out with respect to the first pre-treated toner and the second pre-treated toner and the net strength of the metal elements (zinc, magnesium, aluminum, calcium, barium, or the like) which are included in the fatty acid metal salt particles is measured. The net strength of the second pre-treated toner is divided by the net strength of the first pre-treated toner, multiplied by 100, and this value (the net strength of the second pre-treated toner/the net strength of the first pre-treated toner×100) is set as the ratio of strongly attached fatty acid metal salt particles. The fluorescent X-ray measurement is carried out by a fluorescent X-ray apparatus; however, in the exemplary embodiment, XRF1500 which is a fluorescent X-ray measurement apparatus manufactured by SHIMADZU CORP., is used for the measurement.

In the exemplary embodiment, it is preferable to have recesses on the surface of the toner particles. The size of the recess on the surface of the toner particles is preferably a size into which the small-diameter side polishing agent particles and fatty acid metal salt particles may enter. There may be one recess on the surface of the toner particles, or a plurality, but a plurality is preferable.

When there are recesses on the surface of the toner particles, the small-diameter side polishing agent particles and the fatty acid metal salt particles easily enter a state of entering the recesses on the surface of the toner particles, and, in this state, the small-diameter side polishing agent particles and the fatty acid metal salt particles are transferred along with the toner particles to the surface of the intermediate transfer member and easily reach the leading end of the intermediate transfer member cleaning portion. For this reason, it is easier to prevent the occurrence of toner scattering in an image portion and the occurrence of streaky image defects in a non-image portion.

Specifically, the toner particles which have recesses may be toner particles with a shrinkage rate of 2.0% to 40% (preferably, 4.0% to 25%, more preferably 6.0% to 20%).

100 toner particles which are a measurement target are observed using a scanning electron microscope (SEM). By image analysis, the recesses are specified according to the shrinkage rate of the toner particles. When binarizing the SEM image of the toner particles having recesses, convex portions are formed on both sides of the recesses. The length linking the convex portions in one toner particle in a straight line is set as the envelope perimeter and a value obtained by multiplying a value in which a value in which the envelope perimeter is divided by the actual perimeter length of one toner particle is subtracted from 1 by 100 is set as the shrinkage rate, and set as the value specifying the recesses. In a case where there are no recesses, the shrinkage rate is 0, and when the recesses are large or the number of recesses increases, the shrinkage rate is increased. In the image analysis for determining the shrinkage rate of 100 toner particles which are the measurement target, a two-dimensional image with a magnification of 10,000 is imaged using an analysis apparatus (ERA-8900: ELIONIX INC.) and, using image analysis software WINROOF (MITANI CORP.), a shrinkage rate is determined from the envelope perimeter and the actual perimeter with a condition of 0.010000 μm/pixel.

Detailed description will be given below of the toner according to the exemplary embodiment.

The toner according to the exemplary embodiment includes toner particles and an external additive.

Toner Particles

The toner particles include a binder resin. The toner particles may include coloring agents, releasing agents, and other additives as necessary.

Binder Resin

Examples of binder resins include homopolymers of monomers such as styrenes (such as styrene, para-chloro styrene, α-methyl styrene, or the like), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenically unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or vinyl resins formed of copolymers combining two or more types of these monomers.

Examples of binder resins include non-vinyl resins of epoxy resin, polyester resin, polyurethane resin, polyamide resin, cellulose resin, polyether resin, or modified rosin, mixtures of the above and vinyl resin, graft polymers obtained by polymerizing a vinyl monomer in the presence of the above, and the like.

These binder resins may be used as one type alone, or in a combination of two or more types.

As the binder resin, a polyester resin is preferable. Examples of the polyester resin include known polyester resins.

Examples of the polyester resin include polycondensates of a polycarboxylic acid and polyol. The polyester resin may be a commercially available product, or may be synthesized for use.

Examples of polyvalent carboxylic acid include aliphatic dicarboxylic acid (for example, oxalic acid, malonic acid, maleic acid, fumaric acid, citraconic acid, itaconic acid, glutaconic acid, succinic acid, alkenylsuccinic acid, adipic acid, sebacic acid, and the like), alicyclic dicarboxylic acids (for example, cyclohexane dicarboxylic acid, or the like), aromatic dicarboxylic acid (for example, terephthalic acid, isophthalic acid, phthalic acid, naphthalene dicarboxylic acid, or the like), anhydrides thereof, or lower (for example, with 1 to 5 carbon atoms) alkyl esters thereof. Among these, as the polyvalent carboxylic acid, for example, aromatic dicarboxylic acid is preferable.

Regarding the polycarboxylic acids, a trivalent or higher carboxylic acid with a cross-linked structure or branched structure may be used in combination with a dicarboxylic acid. Examples of the trivalent or higher carboxylic acid include trimellitic acid, pyromellitic acid, anhydrides thereof, or lower (for example, 1 to 5 carbon atoms) alkyl esters thereof.

The polycarboxylic acid may be used alone, or may be used in a combination of two or more types.

Examples of polyols include aliphatic diols (for example, ethylene glycol, diethylene glycol, triethylene glycol, propylene glycol, butane diol, hexane diol, neopentyl glycol, or the like), alicyclic diols (for example, cyclohexane diol, cyclohexane dimethanol, hydrogenated bisphenol A, or the like), aromatic diols (for example, ethylene oxide adducts of bisphenol A, propylene oxide adducts of bisphenol A, or the like). Among the above, as the polyol, for example, aromatic diol and alicyclic diols are preferable, and aromatic diols are more preferable.

As the polyol, a trivalent or higher polyol with a cross-linked structure or branched structure may be used together with a diol. Examples of trivalent or higher polyol include glycerin, trimethylol propane, pentaerythritol, and the like.

The polyol may be used alone, or may be used in a combination of two or more types.

The glass transition temperature (Tg) of the polyester resin is preferably 50° C. to 80° C., and more preferably 50° C. to 65° C.

The glass transition temperature is determined from a DSC curve obtained by differential scanning calorimetry (DSC), more specifically, determined using the "extrapolated glass transition start temperature" described in the method for determining the glass transition temperature of "transition temperature measuring method for plastics" of JIS K 7121-1987.

The weight average molecular weight (Mw) of the polyester resin is preferably 5,000 to 1,000,000, and more preferably 7,000 to 500,000.

The number average molecular weight (Mn) of the polyester resin is preferably 2,000 to 100,000.

The molecular weight distribution (Mw/Mn) of the polyester resin is preferably 1.5 to 100, and more preferably 2 to 60.

The weight average molecular weight and number average molecular weight are measured using gel permeation chromatography (GPC). The molecular weight measurement using GPC is performed using GPC HLC-8120GPC as a measuring apparatus and using a column manufactured by TOSOH CORP., TSKGEL SUPERHM-M (15 cm), in a THF solvent. The weight average molecular weight and number average molecular weight are calculated using a molecular weight calibration curve created using a monodisperse polystyrene standard sample from the measurement results.

The polyester resin is obtained by a known preparation method. Specifically, for example, the polyester resin is obtained by a method in which the polymerization temperature is set to 180° C. to 230° C., the pressure in the reaction system is reduced as necessary, and reaction is carried out while removing water or alcohol generated during the polycondensation.

In a case where the monomers of the raw materials are not dissolved or compatible at the reaction temperature, a high boiling point solvent may be added as a solubilizing agent to dissolve the monomers of the raw materials. In such a case, the polycondensation reaction is performed while distilling off the solubilizing agent. In a case where a monomer with poor compatibility is present in the polymerization reaction, advance polycondensation of the monomer with poor compatibility may be carried out with the main component after condensation of the monomer with polycondensed acid or alcohol.

The content of the binder resin is, for example, preferably 40% by weight to 95% by weight with respect to all of the toner particles, more preferably 50% by weight to 90% by weight, and 60% by weight to 85% by weight is even more preferable.

Coloring Agents Examples of coloring agents include various pigments such as carbon black, chrome yellow, hansa yellow, benzidine yellow, threne yellow, quinoline yellow, pigment yellow, permanent orange gtr, pyrazolone orange, vulcan orange, watchung red, permanent red, brilliant carmine 3b, brilliant carmine 6b, du pont oil red, pyrazolone red, lithol red, rhodamine b lake, lake red c, pigment red, rose bengal, aniline blue, ultramarine blue, calco oil blue, methylene blue chloride, phthalocyanine blue, pigment blue, phthalocyanine green, and malachite green oxalate, or various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, thiazole dyes, and the like.

The coloring agent may be used as one type alone, or may be used in a combination of two or more types.

As the coloring agent, a surface-treated coloring agent may be used as necessary, or the coloring agent may be used in combination with a dispersing agent. In addition, plural types of coloring agents may be used in combination.

The content of the coloring agent is, for example, preferably 1% by weight to 30% by weight with respect to all of the toner particles, and more preferably 3% by weight to 15% by weight.

Releasing Agent

Examples of the releasing agent include natural waxes such as hydrocarbon wax; carnauba wax, rice wax, and candelilla wax; synthetic, mineral, and petroleum waxes such as montan wax; ester waxes such as fatty acid esters, and montanic acid ester; and the like. The releasing agent is not limited thereto.

The melting temperature of the releasing agent is preferably 50° C. to 110° C., and more preferably 60° C. to 100° C.

The melting temperature is determined from the "melting peak temperature" described in the method for determining the melting temperature in the "transition temperature measuring method for plastics" of JIS K 7121-1987 from a DSC curve obtained by differential scanning calorimetry (DSC).

The content of the releasing agent is preferably 1% by weight to 20% by weight with respect to all of the toner particles, and more preferably 5% by weight to 15% by weight.

Other Additives

Examples of other additives include known additives such as magnetic materials, charge control agents, inorganic particles, and the like. These additives are included in the toner particles as internal additives.

Characteristics of Toner Particles

The toner particles may be toner particles with a single-layer structure, or may be toner particles with a so-called core-shell structure formed by a core (core particle) and a coating layer (shell layer) which coats the core.

The toner particles with the core-shell structure may be formed by a core which is formed by including a binder resin and other additives such as coloring agent and a releasing agent as necessary, and a coating layer which is formed by including a binder resin.

The shape factor SF1 of the toner particles is preferably 110 to 150, and 120 to 140 is more preferable.

The shape factor SF1 is obtained by the following formula.

$$SF1=(ML^2/A)\times(\pi/4)\times 100 \qquad \text{Formula:}$$

In the formula described above, ML represents the absolute maximum length of the toner, and A represents the projected area of the toner.

Specifically, the shape factor SF1 is mainly quantified by analysis of a microscopic image or a scanning electron microscope (SEM) image using an image analyzer, and calculated as follows. That is, an optical microscope image of particles scattered on a slide glass surface is taken into a LUZEX image analysis apparatus by a video camera, the maximum length and the projected area of 100 particles are determined, and the shape factor SF1 is obtained by determining the average value through calculation using the formula described above.

External Additives

The external additives include polishing agent particles and fatty acid metal salt particles. The external additives may include other external additives. That is, only polishing agent particles and fatty acid metal salt particles may be externally added to the toner particles, or polishing agent particles, fatty acid metal salt particles, and other external additives may be externally added.

Polishing Agent Particles

The polishing agent particles are not particularly limited; however, examples thereof include inorganic particles such as metal oxides such as cerium oxide, magnesium oxide, aluminum oxide (alumina), zinc oxide, and zirconia; carbides such as silicon carbide; nitrides such as boron nitride; pyrophosphates such as calcium pyrophosphate particles; carbonates such as calcium carbonate and barium carbonate; titanate metal salt particles such as barium titanate, magnesium titanate, calcium titanate, and strontium titanate; and the like. The polishing agent particles may be used alone as one type, or may be used in a combination of two or more. Among these, the polishing agent particles are preferably particles of titanate metal salt, and, from the point of view of the function as a polishing agent, availability, and cost, strontium titanate particles are more preferable.

The polishing agent particles may be subjected to a surface hydrophobic treatment using a hydrophobic treatment agent. Examples of the hydrophobic treatment agent include known organic silicon compounds having an alkyl group (for example, a methyl group, an ethyl group, a propyl group, a butyl group, or the like) and specific examples thereof include silane compounds (for example, such as methyl trimethoxysilane, dimethyldimethoxysilane, trimethylchlorosilane, trimethyl silane) and silazane compounds (for example, hexamethyldisilazane, tetramethyl disilazane, or the like) and the like. The hydrophobic treatment agent may be used alone as one type, or may be used in a combination of two or more.

The content of the polishing agent particles (external addition amount) is preferably 0.01% by weight to 5% by weight with respect to the toner particles, more preferably 0.02% by weight to 2% by weight, even more preferably 0.05% by weight to 1.5% by weight, and most preferably 0.1% by weight to 1% by weight.

Fatty Acid Metal Salt Particles

The fatty acid metal salt particles are particles of salt formed of fatty acids and metal.

The fatty acids may be either saturated fatty acid or unsaturated fatty acid. The number of carbon atoms of the fatty acid is 10 to 25 (preferably 12 to 22). The number of carbon atoms in the fatty acid includes the carbon of the carboxy group.

Examples of the fatty acid include unsaturated fatty acids such as behenic acid, stearic acid, palmitic acid, myristic acid, and lauric acid; unsaturated fatty acids such as oleic acid, linoleic acid, and ricinoleic acid; and the like. Among these fatty acids, stearic acid and lauric acid are preferable, and stearic acid is more preferable.

The metal may be a divalent metal. Examples of the metal include magnesium, calcium, aluminum, barium, zinc, and the like. Among the above, zinc is a preferable metal.

Examples of the fatty acid metal salt particles include particles of metal salts of stearic acid such as aluminum stearate, calcium stearate, potassium stearate, magnesium stearate, barium stearate, lithium stearate, zinc stearate, copper stearate, lead stearate, nickel stearate, strontium stearate, cobalt stearate, sodium stearate, and the like; metal salts of palmitic acid such as zinc palmitate, cobalt palmitate, copper palmitate, magnesium palmitate, aluminum palmitate, and calcium palmitate; metal salts of lauric acid such as zinc laurate, manganese laurate, calcium laurate, iron laurate, magnesium laurate, and aluminum laurate; metal salts of oleic acid such as zinc oleate, manganese oleate, iron oleate, aluminum oleate, copper oleate, magnesium oleate, and calcium oleate; metal salts of linoleic acid such as zinc linoleic acid, cobalt linoleic acid, and calcium linoleic acid; metal salts of ricinoleic acid such as zinc ricinoleic acid, and aluminum ricinoleic acid; and the like.

Among the above, preferable examples of the fatty acid metal salt particles include particles of metal salts of stearic acid, or metal salts of lauric acid, more preferably, particles of zinc stearate or zinc laurate, and even more preferably zinc stearate particles.

The method for preparing the fatty acid metal salt particles is not particularly limited, and examples thereof include a method for cationic substitution of the fatty acid alkali metal salts, a method for directly reacting fatty acids and metal hydroxide, and the like.

Taking a method for preparing zinc stearate particles as the fatty acid metal salt particles, examples thereof include a method for cationic substitution of the sodium stearate, a method for reacting stearic acid and zinc hydroxide, and the like.

The content of the fatty acid metal salt particles (external addition amount) is preferably 0.02 parts by weight to 5 parts by weight with respect to 100 parts by weight of the toner particles, more preferably 0.05 parts by weight to 3.0 parts by weight, and even more preferably 0.08 parts by weight to 1.0 part by weight.

The weight ratio of the polishing agent particles to the fatty acid metal salt particles is preferably from 1:40 to 20:1.

Other External Additives

Examples of other external additives include inorganic particles (referred to below as "small-diameter inorganic particles") with a number average particle diameter of 1 μm or less (preferably 500 nm or less). The number average particle diameter of the small-diameter inorganic particles is a value measured by the same method as the number average particle diameter of the polishing agent particles.

Examples of the small-diameter inorganic particles include $SiO_2$, $TiO_2$, CuO, $SnO_2$, $Fe_2O_3$, BaO, CaO, $K_2O$, $Na_2O$, $CaO.SiO_2$, $K_2O.(TiO_2)n$, $A_{12}O_3.2SiO_2$, $MgCO_3$, $BaSO_4$, $MgSO_4$, and the like.

The surface of the small-diameter inorganic particles as another external additive may be subjected to a hydrophobic treatment. The hydrophobic treatment is performed by, for example, immersing the inorganic particles in a hydrophobic treatment agent, or the like. The hydrophobic treatment agent is not particularly limited; however, examples thereof include silane coupling agents, silicone oils, titanate coupling agents, aluminum coupling agents, and the like. The above may be used alone as one type, or may be used in a combination of two or more types.

The amount of the hydrophobic treatment agent is normally, for example, 1 part by weight to 10 parts by weight with respect to 100 parts by weight of the small-diameter inorganic particles.

Examples of other external additives include resin particles (resin particles such as polystyrene, polymethyl methacrylate (PMMA), and melamine resin), and cleaning aids (for example, particles of a fluorine high molecular weight material), and the like.

The external addition amount of the other external additives is preferably 0.01% by weight to 5% by weight with respect to the toner particles, and more preferably 0.01% by weight to 2.0% by weight.

Method for Preparing Toner

Next, description will be given of a method for preparing the toner according to the exemplary embodiment.

The toner according to the exemplary embodiment is obtained by the external addition of external additives with respect to the toner particles as necessary after preparing the toner particles.

The toner particles may be prepared by any one of a dry preparation method (for example, a kneading and pulverizing method or the like) or a wet preparation method (for example, an aggregation coalescence method, a suspension polymerization method, a dissolution suspension method, or the like). The method for preparing the toner particles is not particularly limited to these methods and a known method may be adopted.

Among the above, it is preferable if the toner particles are obtained by the aggregation coalescence method.

Specifically, for example, in a case of preparing the toner particles using the aggregation coalescence method, the toner particles are prepared through a step of preparing a resin particle dispersion in which resin particles which are the binder resin are dispersed (a resin particle dispersion preparation step), a step of forming aggregated particles by aggregating resin particles (and other particle as necessary) in the resin particle dispersion (in the dispersion after mixing other particle dispersions as necessary) (an aggregated particle forming step), and a step of forming toner particles by heating the aggregated particle dispersion in which the aggregated particles are dispersed and coalescing the aggregated particles (coalescing step).

Detailed description will be given below of each step.

In the following description, description will be given of a method for obtaining toner particles which include a coloring agent and a releasing agent; however, the coloring agent and the releasing agent may be used as necessary. Naturally, additives other than the coloring agent and the releasing agent may be used.

Resin Particle Dispersion Preparation Step

First, a resin particle dispersion in which the resin particles which are the binder resin are dispersed is prepared along with a coloring agent particle dispersion in which coloring agent particles are dispersed and a releasing agent particle dispersion in which releasing agent particles are dispersed.

The resin particle dispersion is prepared by dispersing resin particles in a dispersion medium using a surfactant, for example.

Examples of dispersion media to be used in the resin particle dispersion include aqueous media and the like.

Examples of aqueous media include water such as distilled water, and ion-exchange water, alcohol, and the like. The above may be used alone as one type, or may be used in a combination of two or more types.

Examples of surfactant include anionic surfactants such as sulfuric acid ester salt surfactants, sulfonic acid salt surfactants, phosphoric acid esters surfactants, and soap surfactants; cationic surfactants such as amine salt-type surfactants, and quaternary ammonium salt-type surfactants; non-ionic surfactants such as polyethylene glycol surfactants, alkylphenol ethylene oxide adduct surfactants, and polyol surfactants; and the like. Among the above, in particular, examples include anionic surfactants and cationic surfactants. The non-ionic surfactant may be used in combination with an anionic surfactant or a cationic surfactant.

The surfactants may be used alone as one type, or may be used in a combination of two or more types.

Examples of methods for dispersing the resin particles in the dispersion medium in the resin particle dispersion include general dispersion methods such as a rotary shearing-type homogenizer, a ball mill with media, a sand mill, and a dyno mill. In addition, depending on the type of resin particles, the resin particles may be dispersed in the resin particle dispersion using, for example, a phase inversion emulsification method.

The phase inversion emulsification method is a method in which, after the resin to be dispersed is allowed to dissolve in a hydrophobic organic solvent in which the resin is soluble and neutralized by adding a base to the organic continuous phase (O phase), the resin is converted from W/O to O/W (so-called phase inversion) by adding an aqueous medium (W phase), the phase becomes discontinuous, and the resin is dispersed in particle form in the aqueous medium.

The volume average particle diameter of the resin particles dispersed in the resin particle dispersion is, for example, preferably 0.01 μm to 1 μm, more preferably 0.08 μm to 0.8 μm, and even more preferably 0.1 μm to 0.6 μm.

Regarding the volume average particle diameter of the resin particles, using a particle size distribution obtained by measurement with a laser diffraction-type particle size distribution measuring apparatus (for example, LA-700 manufactured by HORIBA, LTD.), with respect to divided particle size ranges (channels), the volume is measured with the cumulative distribution subtracted from a small particle diameter side and the particle diameter at 50% cumulative volume with respect to all of the particles set as the volume average particle diameter D50v. The volume average particle diameter of the particles in the other dispersion is also measured in the same manner.

The content of the resin particles included in the resin particle dispersion is, for example, preferably 5% by weight to 50% by weight, and more preferably 10% by weight to 40% by weight.

In the same manner as the resin particle dispersion, for example, a coloring agent particle dispersion and a releasing agent particle dispersion are also prepared. In other words, in relation to the volume average particle diameter of the particles in the resin particle dispersion, the dispersion medium, the dispersion method, and the content of the particles, the same is applied to the coloring agent particles to be dispersed in the coloring agent particle dispersion, and the releasing agent particles to be dispersed in a releasing agent particle dispersion.

Aggregated Particle Forming Step

Next, the resin particle dispersion is mixed with the coloring agent particle dispersion and the releasing agent particle dispersion.

In the mixed dispersion, aggregated particles are formed including resin particles, coloring agent particles, and releasing agent particles having diameters close to the diameter of the toner particles with the object of carrying out hetero-aggregation on the resin particles, coloring agent particles, and releasing agent particles.

Specifically, for example, after adding an aggregation agent to the mixed dispersion, adjusting the pH of the mixed dispersion to be acidic (for example, a pH of 2 to 5), and adding a dispersion stabilizing agent as necessary, heating is carried out to the temperature of the glass transition temperature of the resin particles (specifically, for example, the glass transition temperature of the resin particles is −30° C. to 10° C.), the particles dispersed in the mixed dispersion are aggregated, and aggregated particles are formed.

In the aggregated particle forming step, for example, the aggregating agent described above is added while stirring a mixed dispersion in a rotary shear homogenizer at room temperature (for example, 25° C.), the pH of the mixed dispersion is adjusted to be acidic (for example, a pH of 2 to 5), and a dispersion stabilizing agent is added as necessary, after which the heating described above may be performed.

Examples of aggregating agents include surfactants with the reverse polarity of surfactants used as dispersing agents to be added to the mixed dispersion, inorganic metal salt, and divalent or higher metal complexes. In particular, in a case where a metal complex is used as an aggregating agent, the usage amount of the surfactant is reduced and the charging characteristics are improved.

Additives for forming a complex with the metal ions of the aggregating agent or a similar bond may be used as necessary. Chelating agents are preferably used as the additive.

Examples of inorganic metal salts include metal salts such as calcium chloride, calcium nitrate, barium chloride, magnesium chloride, zinc chloride, aluminum chloride, and aluminum sulfate; inorganic metal salt polymers such as polyaluminum chloride, polyaluminum hydroxide, and calcium polysulfide; and the like.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), ethylene diamine tetraacetic acid (EDTA), and the like.

The added amount of the chelating agent is, for example, preferably 0.01 parts by weight to 5.0 parts by weight with respect to the 100 parts by weight of the resin particles, and more preferably 0.1 parts by weight or more to less than 3.0 parts by weight.

Coalescing Step

Next, for example, by heating the aggregation particle dispersion in which the aggregated particles are dispersed to the glass transition temperature or more of the resin particles (for example, to a temperature from 10 to 30° C. higher than the glass transition temperature of the resin particles, or higher), the aggregated particles are coalesced to form the toner particles.

Toner particles are obtained through the above steps.

The toner particles may be prepared through a step of forming second aggregation particles by, after obtaining the aggregation particle dispersion in which the aggregated particles are dispersed, further mixing the aggregation particle dispersion and the resin particle dispersion in which the resin particles are dispersed, and aggregating resin particles so as to be further attached to the surface of the aggregated particles, and a step of forming toner particles with a core/shell structure by heating the second aggregation particle dispersion in which the second aggregated particles are dispersed and coalescing the second aggregated particles.

After the coalescing step is completed, toner particles are obtained in a state where the toner particles formed in the solution are dried through a known cleaning step, a solid-liquid separation step, and a drying step.

The cleaning step may be satisfied by sufficiently carrying out substitution cleaning using ion-exchange water from the point of view of the charging property. In addition, the solid-liquid separation step is not particularly limited; however, suction filtration, pressure filtration, or the like may be carried out from the point of view of productivity. In addition, the drying step is also not particularly limited to any method, but from the point of view of productivity, freeze drying, flash jet drying, fluidized drying, vibration fluidized drying, and the like may be carried out.

The toner according to the exemplary embodiment is prepared by adding and mixing external additives with the toner particles obtained in a dried state. The mixing may be performed, for example, using a V BLENDER, a HENSCHEL MIXER, a LÖDIGE MIXER, or the like. In addition, as necessary, coarse particles of toner may be removed using a vibration sieving machine, a wind classifier, or the like.

The toner having recesses on the surface is prepared by adjusting the time and temperature of the coalescing step.

Electrostatic Image Developer

The electrostatic image developer according to the exemplary embodiment includes at least the toner according to the exemplary embodiment.

The electrostatic image developer according to the exemplary embodiment may be a single-component developer including only the toner according to the exemplary embodiment, or may be a two-component developer mixing the toner and a carrier.

The carrier is not particularly limited, and examples thereof include known carriers. Examples of the carrier include a coating carrier in which a coating resin is coated on the surface of a core material formed of a magnetic particles; a magnetic particle-dispersed-type carrier in which magnetic particles are dispersed and incorporated into a matrix resin; a resin-impregnated-type carrier in which a resin is impregnated into porous magnetic particles; and the like.

The magnetic particle dispersion-type carrier and the resin-impregnated-type carrier may be carriers in which the constituent particles of the carrier are set as the core material and then coated with a coating resin.

Examples of the magnetic particles include magnetic metal such as iron, nickel, and cobalt, magnetic oxides such as ferrite, magnetite, and the like.

Examples of coating resins and matrix resins include straight silicone resins or modified products thereof formed to include polyethylene, polypropylene, polystyrene, polyvinyl acetate, polyvinyl alcohol, polyvinyl butyral, polyvinyl chloride, polyvinyl ether, poly vinyl ketone, vinyl chloride-vinyl acetate copolymers, styrene-acrylic acid copolymers, and organosiloxane bonds, fluorine resins, polyesters, polycarbonate, phenol resins, epoxy resins, and the like.

Other additives such as conductive particles may be included in the coating resin and the matrix resin.

Examples of the conductive particles include metals such as gold, silver, and copper, particles such as carbon black, titanium oxide, zinc oxide, tin oxide, barium sulfate, aluminum borate, and potassium titanate.

Examples of methods for coating the coating resin on the surface of the core material include a method for coating using a coating layer-forming solution in which a coating resin and various additives as necessary are dissolved in an appropriate solvent. The solvent is not particularly limited and may be selected based on the coating resin to be used, the coating suitability, and the like.

Specific examples of the resin coating method include an immersion method of immersing a core material in a coating layer-forming solution, a spray method of spraying a coating layer-forming solution on a core material surface, a fluidized bed method of spraying a coating layer-forming solution in a state where a core material is floating on fluidizing air, a kneader coater method in which the core material of the carrier and the coating layer-forming solution are mixed in a kneader coater, and the solvent is removed, and the like.

In the two-component developer, the mixing ratio (weight ratio) of the toner and the carrier is preferably toner: carrier=1:100 to 30:100, and more preferably 3:100 to 20:100.

Image Forming Apparatus/Image Forming Method

Description will be given of an image forming apparatus/image forming method according to the exemplary embodiment.

The image forming apparatus according to the exemplary embodiment is provided with an image holding member, a charging unit for charging the surface of the image holding member, an electrostatic image forming unit for forming an electrostatic image on the surface of the charged image holding member, a developing unit for storing an electrostatic image developer and developing an electrostatic image formed on the surface of the image holding member as a toner image using the electrostatic image developer, an intermediate transfer member where the toner image is transferred onto the surface, a primary transfer unit which carries out primary transfer of a toner image formed on the surface of the image holding member to the surface of an intermediate transfer member, a secondary transfer unit which carries out secondary transfer of the toner image transferred onto the surface of the intermediate transfer member onto a recording medium, a cleaning unit which has a cleaning blade for cleaning the surface of the intermediate transfer member, a transfer unit for transferring the toner image formed on the surface of the image holding member onto the surface of the recording medium, and a fixing unit for fixing the toner image transferred onto the surface of the recording medium. As an electrostatic image developer, the electrostatic image developer according to the exemplary embodiment is applied.

The image forming apparatus according to the exemplary embodiment carries out an image forming method (the image forming method according to the exemplary embodiment) which has a charging step of charging the surface of the image holding member, an electrostatic image forming step of forming an electrostatic image on the surface of the charged image holding member, developing step of developing the electrostatic image formed on the surface of the image holding member as a toner image using the electrostatic image developer according to the exemplary embodiment, a primary transfer step of carrying out primary transfer of a toner image formed on the surface of the image holding member onto the surface of an intermediate transfer member, a secondary transfer step of carrying out secondary transfer of a toner image transferred onto the surface of the intermediate transfer member onto the surface of a recording medium, a cleaning step of cleaning the surface of the intermediate transfer member using a cleaning blade, and a fixing step of fixing the toner image transferred onto the surface of the recording medium.

As the image forming apparatus according to the exemplary embodiment, a known image forming apparatus may be applied such as an apparatus provided with a cleaning unit for cleaning the surface of the image holding member before charging after transfer of the toner image, and an apparatus provided with a charge neutralizing unit for neutralizing the charge by irradiating the surface of the image holding member with charge neutralizing light after transfer of the toner image and before charging.

In the image forming apparatus according to the exemplary embodiment, a portion which includes the developing unit may have a cartridge structure (a process cartridge) which is detachable from the image forming apparatus. For example, a process cartridge including a developing unit which stores the electrostatic image developer according to the exemplary embodiment may be suitably used as the process cartridge.

An example of the image forming apparatus according to the exemplary embodiment is shown below; however, the image forming apparatus is not limited thereto. The main portions shown in the diagram will be described and description of other portions will be omitted.

FIG. 1 is a schematic configuration diagram which shows an image forming apparatus according to the exemplary embodiment.

The image forming apparatus shown in FIG. 1 is provided with first to fourth image forming units 10Y, 10M, 10C, and 10K (image forming unit) of an electrostatic photographic system, which output images of each color of yellow (Y), magenta (M), cyan (C), and black (K) based on the color-separated image data. These image forming units (may be simply referred to below as "units") 10Y, 10M, 10C, and 10K are arranged to be separated by a predetermined distance from each other in the horizontal direction. These units 10Y, 10M, 10C, and 10K may be process cartridges which are detachable from the image forming apparatus.

Above each of unit 10Y, 10M, 10C, and 10K in the diagram, an intermediate transfer belt 20 is extended as an intermediate transfer member through each of the units. The intermediate transfer belt 20 is provided to be wrapped around a driving roller 22 and a support roller 24 which contacts with the inner surface of the intermediate transfer belt 20, which are arranged separately from each other in the direction from left to right in the diagram, and travels in a direction from the first unit 10Y toward the fourth unit 10K. Force is applied to the support roller 24 in the direction away from the driving roller 22 by a spring or the like which is not shown and tension is applied to the intermediate transfer belt 20 wound around both rollers. In addition, an intermediate transfer member cleaning apparatus 30 is provided on the image holding member side surface of the intermediate transfer belt 20 to oppose the driving roller 22. A cleaning blade 30-1 which cleans the surface of the intermediate transfer belt 20 is provided on the intermediate transfer member cleaning apparatus 30.

In addition, it is possible to supply toner including toner of four colors of yellow, magenta, cyan, and black stored in toner cartridges 8Y, 8M, 8C, and 8K to each of developing apparatuses (developing unit) 4Y, 4M, 4C, and 4K of each unit 10Y, 10M, 10C, and 10K.

Since the first to fourth units 10Y, 10M, 10C, and 10K have the same configuration, here, description will be given of the first unit 10Y which forms a yellow image and which is disposed on the upstream side in the traveling direction of the intermediate transfer belt as a representative. By applying the reference numerals referring to magenta (M), cyan (C), and black (K) to the portions equivalent to the first unit 10Y instead of yellow (Y), description of the second to fourth units 10M, 10C, and 10K may be omitted.

The first unit 10Y has a photoreceptor 1Y which acts as an image holding member. A charging roller (an example of a charging unit) 2Y for charging the surface of the photoreceptor 1Y to a predetermined potential, an exposure apparatus (an example of an electrostatic image forming unit) 3 for forming an electrostatic image by exposing the charged surface based on color-separated image signals using a laser beam 3Y, a developing apparatus (an example of a developing unit) 4Y which develops an electrostatic image by supplying the charged toner to the electrostatic image, a primary transfer roller 5Y (an example of a primary transfer unit) which transfers the developed toner image onto the intermediate transfer belt 20, and a photoreceptor cleaning apparatus (an example of a cleaning unit) 6Y which removes the toner remaining on the surface of the photoreceptor 1Y after the primary transfer, are arranged in order on the periphery of the photoreceptor 1Y.

The primary transfer roller 5Y is disposed on the inner side of the intermediate transfer belt 20 and provided at a position opposing the photoreceptor 1Y. Furthermore, a bias power supply (not shown) which applies a primary transfer bias is connected with each of the primary transfer rollers 5Y, 5M, 5C, and 5K. Each bias power supply varies the transfer bias which is applied to each of the primary transfer rollers under the control of a control unit which is not shown in the diagram.

Description will be given below of an operation for forming a yellow image in the first unit 10Y.

First, prior to the operation, the surface of the photoreceptor 1Y is charged to a potential of −600V to −800V by the charging roller 2Y.

The photoreceptor 1Y is formed by laminating photosensitive layers on a substrate having conductivity (for example, volume resistance ratio: $1\times10^{-6}$ Ωcm or less at 20° C.). The photosensitive layers normally have a high resistance (typical resin resistance); however, the photosensitive layers have a property whereby the specific resistance of the portion irradiated with the laser beam changes when irradiated with the laser beam 3Y. The laser beam 3Y is output to the surface of the charged photoreceptor 1Y via an exposure apparatus 3 according to yellow image data sent from the control unit which is not shown in the diagram. The photosensitive layer on the surface of the photoreceptor 1Y is irradiated with the laser beam 3Y and, due to this, an electrostatic image of a yellow image pattern is formed on the surface of the photoreceptor 1Y.

The electrostatic image is an image formed on the surface of the photoreceptor 1Y by charging, and is a so-called negative latent image which is formed by the specific resistance of the irradiated portion of the photosensitive layer being decreased by the laser beam 3Y, and the charged charge on the surface of the photoreceptor 1Y flowing away while the charge of the portion which is not irradiated with the laser beam 3Y remains.

In this manner, the electrostatic image formed on the photoreceptor 1Y is rotated up to a predetermined development position in accordance with the traveling of the photoreceptor 1Y. In this development position, the electrostatic image on the photoreceptor 1Y is made visible (developed image) as a toner image by a developing apparatus 4Y.

In the developing apparatus 4Y, for example, an electrostatic image developer which includes at least the yellow toner and the carrier is stored. The yellow toner is frictionally charged by stirring in the inside of the developing apparatus 4Y and held on a developer roller (an example of a developer holding member) by having a charge of the same polarity (a negative polarity) as the charge charged on the photoreceptor 1Y. By the surface of the photoreceptor 1Y passing through the developing apparatus 4Y, yellow toner is electrostatically attached to the neutralized latent image unit on the surface of the photoreceptor 1Y and the latent image is developed using yellow toner. The photoreceptor 1Y on which the yellow toner image is formed continues to travel at a predetermined speed and the toner image developed on the photoreceptor 1Y is transported to a predetermined primary transfer position.

When the yellow toner image on the photoreceptor 1Y is fed to the primary transfer, a primary transfer bias is applied by the primary transfer roller 5Y, electrostatic force from the photoreceptor 1Y toward the primary transfer roller 5Y acts on the toner image, and the toner image on the photoreceptor 1Y is transferred onto the intermediate transfer belt 20. The transfer bias applied at this time has (+) polarity which is the reverse polarity of (−) polarity of the toner and, for example, is controlled to be +10 μA by a control unit (not shown) in the first unit 10Y. On the other hand, the toner remaining on the photoreceptor 1Y is removed and recovered by a photoreceptor cleaning apparatus 6Y.

In addition, the primary transfer bias applied to the primary transfer rollers 5M, 5C, and 5K after the second unit 10M is also controlled by the first unit.

In this manner, in the first unit 10Y, the intermediate transfer belt 20 to which the yellow toner image is transferred is transported in order through the second to fourth units 10M, 10C, and 10K, and toner images of each color are superimposed and transferred in a multiplex manner.

The intermediate transfer belt 20 to which toner images of four colors are transferred in a multiplex manner through the first to fourth units reaches a secondary transfer unit formed from the intermediate transfer belt 20, the support roller 24 which contacts with the intermediate transfer belt inner surface, and a secondary transfer roller (an example of a secondary transfer unit) 26 disposed on the image holding surface side of the intermediate transfer belt 20. On the other hand, the recording sheet (an example of a recording medium) P is fed via a supply mechanism at a predetermined timing in a space when the secondary transfer roller 26 contacts with the intermediate transfer belt 20, and a secondary transfer bias is applied by the support roller 24. The transfer bias which is applied at this time has (−) polarity which is the same polarity as the (−) polarity as the toner, an electrostatic force from the intermediate transfer belt 20 toward the recording sheet P acts on the toner image, and the toner image on the intermediate transfer belt 20 is transferred onto the recording sheet P. The secondary transfer bias at this time is determined according to the resistance detected by a resistance detection unit (not shown) for detecting the resistance of the secondary transfer portion, and is voltage-controlled.

On the other hand, the toner remaining on the intermediate transfer belt 20 is recovered by removal with the cleaning blade 30-1 of the intermediate transfer member cleaning apparatus 30.

After this, the recording sheet P is put into the contact portions (nipping units) of a pair of fixing rollers in the fixing apparatus (an example of a fixing unit) 28, the toner image is fixed onto the recording sheet P, and a fixed image is formed.

Examples of the recording sheet P for transferring the toner image is normal paper which is used in an electrostatic photographic copier, a printer, or the like. Examples of the recording medium include OHP sheets or the like in addition to the recording sheet P.

To further improve the smoothness of the image surface after the fixing, the surface of the recording sheet P is also preferably smooth and, for example, coated paper where the surface of normal paper is coated with a resin or the like, art paper for printing, or the like are suitable for use.

The recording sheet P where the fixing of the color image is completed is unloaded toward a discharge portion and the series of color image forming operation is finished.

Process Cartridge/Toner Cartridge

Description will be given of the process cartridge according to the exemplary embodiment.

The process cartridge according to the exemplary embodiment is provided with a developing unit for storing the electrostatic image developer according to the exemplary embodiment and developing an electrostatic image formed on the surface of the image holding member as a toner image, and is a process cartridge which is detachable from the image forming apparatus.

The process cartridge according to the exemplary embodiment is not limited to the configuration described above, and may have a configuration which is provided with a developing apparatus, and at least one which is selected from other units such as, for example, an image holding member, a charging unit, an electrostatic image forming unit, and a transfer unit as necessary.

An example of a process cartridge according to the exemplary embodiment is shown below, but the present invention is not limited thereto. The main portions shown in the diagram will be described and description of other portions will be omitted.

Figure 2:
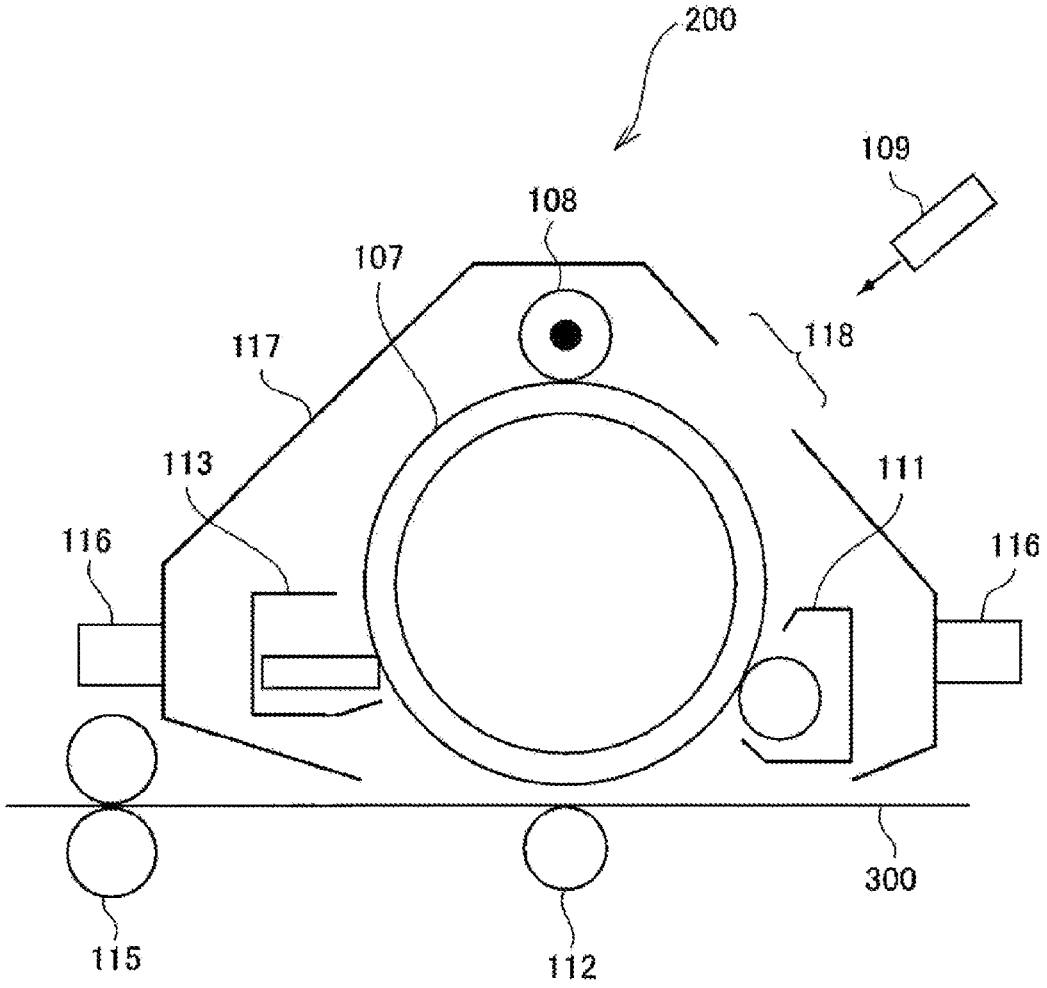
FIG. 2 is a schematic configuration diagram which shows a process cartridge according to the exemplary embodiment.

FIG. 2 is a schematic configuration diagram which shows a process cartridge according to the exemplary embodiment.

A process cartridge 200 shown in FIG. 2, for example, is formed to integrally hold a combination of a photoreceptor 107 (one example of an image holding member), a charging roller 108 provided at the periphery of the photoreceptor 107 (an example of a charging unit), a developing apparatus 111 (an example of a developing unit), and a photoreceptor cleaning apparatus 113 (an example of a cleaning unit), using housing 117 provided with mounting rails 116 and an opening portion 118 for exposure, in the form of a cartridge.

In FIG. 2, 109 is an exposure apparatus (an example of the electrostatic image forming unit), 112 is a transfer apparatus (an example of a transfer unit), 115 is a fixing apparatus (an example of fixing unit), and 300 is a recording sheet (an example of a recording medium).

Next, description will be given of the toner cartridge according to the exemplary embodiment.

The toner cartridge according to the exemplary embodiment may store the toner according to the exemplary embodiment and may be detachable from the image forming apparatus. The toner cartridge stores replenishment toner for supply to the developing unit provided in the image forming apparatus. The toner cartridge may have a container which contains the toner according to the exemplary embodiment.

The image forming apparatus shown in FIG. 1 is an image forming apparatus which has a configuration in which toner cartridges 8Y, 8M, 8C, and 8K are detachable, and developing apparatuses 4Y, 4M, 4C, and 4K are connected with toner cartridges corresponding to each of the developing apparatuses (colors) by a toner supply tube which is not shown in the diagram.

In addition, in a case where the toner stored in the toner cartridge is low, the toner cartridge is replaced.

EXAMPLE

More specific detailed description will be given of the exemplary embodiment using Examples and Comparative Examples; however, the exemplary embodiment is not limited to these examples. In addition, "parts" and "%" are based on weight unless otherwise specified.

Preparation of Toner Particles

Toner Particles (1)

Preparation of Polyester Resin Dispersion

Ethylene glycol [manufactured by WAKO PURE CHEMICAL INDUSTRIES, LTD. 37 parts

Neopentyl glycol [manufactured by WAKO PURE CHEMICAL INDUSTRIES, LTD.] 65 parts 1,9-nonanediol [manufactured by WAKO PURE CHEMICAL INDUSTRIES, LTD.] 32 parts Terephthalic acid [manufactured by WAKO PURE CHEMICAL INDUSTRIES, LTD.] 96 parts The monomers described above are introduced to a flask, the temperature is increased up to 200° C. over one hour, and the inside of the reaction system is confirmed to be stirred, after which 1.2 parts of dibutyltin oxide are introduced. Furthermore, while distilling off the generated water, the temperature is increased up to 240° C. over 6 hours, a dehydration condensation reaction continued for a further 4 hours at 240° C., and a polyester resin A with an acid value of 9.4 mgKOH/g, a weight average molecular weight of 13,000, and a glass transition temperature of 62° C. is obtained.

Next, while in a molten state, the polyester resin A is transferred at a rate of 100 parts per minute in a CAVITRON CD1010, manufactured by EUROTECH. 0.37% concentration dilute aqueous ammonia in which reagent aqueous ammonia is diluted with ion-exchange water is placed into an aqueous medium tank prepared separately and, while heating to 120° C. in a heat exchanger, is transferred to the CAVITRON with the polyester resin melt described above at a rate of 0.1 liter per minute.

The CAVITRON is driven under the conditions of the rotation speed of a rotor being 60 Hz and a pressure of 5 kg/cm2, an amorphous polyester resin dispersion in which resin particles with a volume average particle diameter of 160 nm, 30% solid content, a glass transition temperature of 62° C., and a weight average molecular weight Mw of 13,000 are dispersed.

Preparation of Coloring Agent Particle Dispersion

Cyan pigment [C.I. Pigment Blue 15:3, manufactured by DAINICHISEIKA COLOR & CHEMICALS MFG. CO., LTD.] 10 parts Anionic surfactant [NEOGEN SC, manufactured by DKS CO., LTD.]2 parts Ion-exchange water 80 parts The above components are mixed, dispersed for one hour in a high pressure impact-type dispersing machine ALTIMIZER [HJP30006, manufactured by SUGINO MACHINE LTD], and a coloring agent particle dispersion with a volume average particle diameter of 180 nm and a solid content of 20% is obtained.

Preparation of Release Agent Particle Dispersion

Paraffin wax [HNP 9, manufactured by NIPPON SEIRO CO., LTD.]50 parts

Anionic surfactant [NEOGEN SC, manufactured by DKS Co., Ltd.]2 parts

Ion-exchange water 200 parts

The components described above are heated to 120° C. and sufficiently mixed and dispersed using an ULTRA TURRAX T50, manufactured by IKA Inc., after which a dispersion process is carried out in a pressure discharge-type homogenizer, and a releasing agent particle dispersion with a volume average particle diameter of 200 nm and a solid content of 20% is obtained.

Preparation of Toner Particles (1)

Polyester resin particle dispersion 200 parts

Coloring agent particle aqueous dispersion 25 parts

Release agent particle dispersion 30 parts

Polyaluminum chloride 0.4 parts

Ion-exchange water 100 parts

The components described above are introduced into a stainless steel flask, sufficiently mixed and dispersed using an ULTRA TURRAX manufactured by IKA Inc., after which heating is carried out to 45° C. while stirring the flask in an oil bath for heating. After holding for 15 minutes at 45° C., 70 parts of the same polyester resin dispersion as described above are slowly added.

Subsequently, after adjusting the pH in the system to 8.0 using an aqueous solution of sodium hydroxide with a concentration of 0.5 mol/L, the stainless steel flask is sealed, and, while continuing stirring after magnetically sealing a seal on the stirring shaft, heating is carried out up to 90° C., and the resultant is held for 3 hours. After completion of the reaction, cooling is carried out with a cooling rate of 2° C./min and, after carrying out filtration and sufficient cleaning with ion-exchange water, solid-liquid separation is performed by nutsche suction filtration. The resultant is further re-dispersed with 3 L of ion-exchange water at 30° C. and stirred and cleaned at 300 rpm for 15 minutes. This cleaning operation is further repeated six times, and when the pH of the filtrate is 7.54 and the electric conductivity is 6.5 μS/cm, solid-liquid separation is performed by nutsche suction filtration using a No. 5A filter. Next, toner particles (1) are obtained by continuously carrying out vacuum drying for 12 hours.

The volume average particle diameter Dt of the toner particles (1) (=D50v) is 3.2 μm, SF1 is 130, and the shrinkage rate is 18.4%.

Toner Particles (2)

Toner particles (2) with a volume average particle diameter Dt (=D50v) of 9.6 μm, an SF1 of 132, and a shrinkage rate of 16.21% are prepared in the same manner as the preparation of the toner particles (1) except that the flask heating temperature is changed to 50° C. and the holding time is changed to 60 minutes.

Toner Particles (3)

Toner particles (3) having few recesses with a volume average particle diameter Dt (=D50v) of 3.5 μm, an SF1 of 120, and a shrinkage rate of 4.5% are prepared in the same manner as the preparation of the toner particles (1) except that heating is carried out while continuously stirring and the holding temperature is changed to 95° C. for 6 hours.

Preparation of External Additive

Preparation of Polishing Agent Particles

Polishing Agent Particles (A1) to (A12)

After adding strontium chloride and titanium oxide in equivalent molar amounts to metatitanic acid slurry, aqueous ammonia is added at the same time as blowing carbon dioxide gas of a molar amount of two times the titanium oxide at a flow rate of 1 L/min. The pH value at this time is 8. After cleaning the precipitate with water, drying is carried out for 24 hours at 110° C., after which sintering is carried out at 800° C., and polishing agent particles (Ab1) formed of strontium titanate particles are prepared by mechanical grinding and classification. In addition, by adjusting the grinding conditions and classification conditions, polishing agent particles formed of strontium titanate particles (A2) to (A12) are prepared. The obtained polishing agent particles (A1) to (A10) have number particle size distributions with one peak and the particle diameters of the peaks are as follows.

Polishing agent particles (A1): strontium titanate particles (the particle diameter of the peak is 0.12 μm)

Polishing agent particles (A2): strontium titanate particles (the particle diameter of the peak is 1.50 μm)

Polishing agent particles (A3): strontium titanate particles (the particle diameter of the peak is 2.00 μm)

Polishing agent particles (A4): strontium titanate particles (the particle diameter of the peak is 4.60 μm)

Polishing agent particles (A5): strontium titanate particles (the particle diameter of the peak is 5.00 μm)

Polishing agent particles (A6): strontium titanate particles (the particle diameter of the peak is 3.0 μm)

Polishing agent particles (A7): strontium titanate particles (the particle diameter of the peak is 3.5 μm)

Polishing agent particles (A8): strontium titanate particles (the particle diameter of the peak is 8.0 μm)

Polishing agent particles (A9): strontium titanate particles (the particle diameter of the peak is 10.0 μm)

Polishing agent particles (A10): strontium titanate particles (the particle diameter of the peak is 18.0 μm)

In addition, in addition to the polishing agent particles (A1) to (A10) described above, polishing agent particles (A11) to (A12) which have a number particle size distribution with one peak are also prepared as polishing agent particles.

Polishing agent particles (A11): cerium oxide particles (the particle diameter of the peak is 0.2 μm)

Polishing agent particles (A12): cerium oxide particles (the particle diameter of the peak is 4.0 μm)

Mixed Polishing Agent Particles (Ab1) to (Ab12)

Using polishing agent particles (A1) to (A14), two types of polishing agent particles (first and second polishing agent particles) are mixed in the combinations and amounts shown in Table 1 and polishing agent particles (Ab1) to (Ab12) are prepared.

TABLE 1

| | Primary polishing agent particles | | Secondary polishing agent particles | | Small-diameter | Large-diameter |
|---|---|---|---|---|---|---|
| | Type | No. of parts | Type | No. of parts | side particle diameter Da [μm] | side particle diameter Db [μm] |
| Polishing agent particles (Ab1) | A1 | 50 | A7 | 50 | 0.12 | 3.5 |
| Polishing agent particles (Ab2) | A1 | 50 | A9 | 50 | 0.12 | 10.0 |
| Polishing agent particles (Ab3) | A1 | 50 | A10 | 50 | 0.12 | 18.0 |
| Polishing agent particles (Ab4) | A2 | 50 | A6 | 50 | 1.50 | 3.0 |
| Polishing agent particles (Ab5) | A2 | 50 | A7 | 50 | 1.50 | 3.5 |
| Polishing agent particles (Ab6) | A2 | 50 | A9 | 50 | 1.50 | 10.0 |
| Polishing agent particles (Ab7) | A3 | 50 | A10 | 50 | 2.00 | 18.0 |
| Polishing agent particles (Ab8) | A4 | 50 | A8 | 50 | 4.60 | 8.0 |
| Polishing agent particles (Ab9) | A4 | 50 | A9 | 50 | 4.60 | 10.0 |

TABLE 1-continued

| | Primary polishing agent particles | | Secondary polishing agent particles | | Small-diameter | Large-diameter |
|---|---|---|---|---|---|---|
| | Type | No. of parts | Type | No. of parts | side particle diameter Da [μm] | side particle diameter Db [μm] |
| Polishing agent particles (Ab10) | A4 | 50 | A10 | 50 | 4.60 | 18.0 |
| Polishing agent particles (Ab11) | A5 | 50 | A9 | 50 | 5.00 | 10.0 |
| Polishing agent particles (Ab12) | A11 | 50 | A12 | 50 | 0.20 | 4.0 |

Preparation of Fatty Acid Metal Salt Particles

Preparation of Fatty Acid Metal Salt Particles (FM1) to (FM5)

1,422 parts of stearic acid are added to 10,000 parts of ethanol and mixed at a liquid temperature of 75° C., after which 507 parts of zinc hydroxide are slowly added and stirring and mixing are carried out for one hour after finishing the introduction thereof. After that, the resultant is cooled to a liquid temperature of 20° C. and the solid content other than ethanol and reaction residue is collected by filtering the product. Using a heating-type vacuum dryer, the collected solid is dried for 3 hours at 150° C. After taking out the solids from the dryer and allowing the solids to cool, solids of zinc stearate are obtained.

After pulverizing the obtained solid in a jet mill, classification is carried out in an elbow jet classifier (manufactured by MATSUBO CORP.), and fatty acid metal salt particles (FM1) formed of zinc stearate particles are obtained. In addition, by adjusting the grinding conditions and classification conditions, fatty acid metal salt particles (FM2) to (FM5) formed of zinc stearate particles are prepared. The obtained fatty acid metal salt particles (FM1) to (FM5) have number particle size distributions with one peak and the particle diameter of the peaks are as follows.

Fatty acid metal salt particles (FM1): stearic acid zinc particles (the particle diameter of the peak is 0.6 μm)

Fatty acid metal salt particles (FM2): stearic acid zinc particles (the particle diameter of the peak is 1.5 μm)

Fatty acid metal salt particles (FM3): stearic acid zinc particles (the particle diameter of the peak is 2.0 μm)

Fatty acid metal salt particles (FM4): stearic acid zinc particles (the particle diameter of the peak is 4.2 μm)

Fatty acid metal salt particles (FM5): stearic acid zinc particles (the particle diameter of the peak is 5.5 μm)

Preparation of Fatty Acid Metal Salt Particles (FM6)

1,001 parts of lauric acid are added to 10,000 parts of ethanol and mixed at a liquid temperature of 75° C., after which 507 parts of zinc hydroxide are slowly added, and stirring and mixing are carried out for one hour after the introduction thereof is finished. After that, the resultant is cooled to a liquid temperature of 20° C., the product is filtered, and the collected solid product other than the ethanol and reaction residue is dried for 3 hours at 150° C. using a heating vacuum dryer. After cooling after collection from the dryer, solids of zinc laurate are obtained. After grinding the obtained solids in a jet mill, classification is carried out with an elbow jet classifier (manufactured by MATSUBO CORP.), and fatty acid metal salt particles (FM6) formed of zinc laurate particles with a particle diameter of a peak of 1.0 μm having a number particle size distribution with one peak are obtained.

Example 1

With respect to 100 parts of the toner particles (1), 0.3 parts of the fatty acid metal salt particles (FM1) are added, using NOBIRUTA (NOBIRUTA NOB130, manufactured by HOSOKAWA MICRON LTD.), fatty acid metal salt particles (FM1) are externally added to the toner particles (1) by stirring under conditions of a clearance of 2 mm, a rotation speed of 3,000 rpm, and stirring for 10 minutes.

Next, 0.3 parts of polishing agent particles (Ab1) and 2.0 parts of silica particles (A 200, manufactured by AEROSIL) are externally added to the toner particles (1) to which the fatty acid metal salt particles (FM1) are added, mixing is carried out for three minutes at 2,000 rpm in a HENSCHEL MIXER, and a toner is obtained.

The obtained toner (1) and the carrier (1) are added to the V blender at a ratio of toner:carrier=5.95 (weight ratio), stirring is carried out for 20 minutes, and a developer is obtained.

As the carrier (1), the carrier obtained by the methods shown below is used.

1,000 parts of Mn—Mg ferrite (volume average particle diameter: 50 μm, manufactured by POWDER TECH GROUP, shape factor SF1:120) are added to a kneader, a solution in which 1.50 parts of perfluorooctyl methyl acrylate-methyl methacrylatecopolymer (polymerization ratio: 20/80, Tg: 72° C., weight average molecular weight: 72,000, manufactured by SOKEN CHEMICAL & ENGINEERING CO., LTD.) are dissolved in 700 parts of toluene, mixing is carried out for 20 minutes at room temperature, after which the resultant is heated to 70° C. and subjected to reduced pressure drying, after which extraction is carried out and a coating carrier is obtained. Furthermore, the obtained coating carrier is sieved by a mesh with holes of 75 μm and a carrier is obtained by removing the coarse particles. The shape factor SF1 of the carrier is 122.

Examples 2 to 14 and Comparative Example 1 to 7

A toner and a developer are obtained in the same manner as Example 1 except that the type and amount of the fatty acid metal salt particles, the stirring conditions using the NOBIRUTA, the type and added amount of the polishing agent particles, and the type of carrier are changed according to Table 2.

Measurement of Physical Properties

For the obtained toner of the developer, the ratio of fatty acid metal salt-attached toner particles, and the ratio of strongly attached fatty acid metal salt particles are measured in accordance with the method described above.

EVALUATION

Using the developers obtained in each Example, color streaks (color streaks A due to toner slipping from the intermediate transfer member cleaning portion and color streaks B due to wear in the intermediate transfer member) and toner scattering are evaluated.

The results are shown in Table 2.

The obtained developers are allowed to stand for one day in a low temperature and low humidity environment (10° C., RH 15%).

After that, the developer is filled into a developing apparatus of an image forming apparatus "700 DIGITAL COLOR PRESS (manufactured by FUJI XEROX CO., LTD.)", and images with an image density (area coverage) of 1% are output onto 100,000 A4 sheets in a high temperature and high humidity environment (28.5° C., RH 85%).

For 100 μmages from the output sheet 99,901 to sheet 100,000, the presence or absence of the occurrence of color streaks A due to toner slipping from the intermediate transfer member cleaning portion and color streaks B due to wear in the intermediate transfer member is visually observed, and the number of sheets where color streaks are caused in a non-image portion is counted.

In addition, for 100 μmages, the presence or absence of the occurrence of toner scattering is visually observed and the number of sheets where toner scattering is caused in the image portion (the periphery of the image portion) is counted.

Each of the evaluation criteria is as follows.

Evaluation Criteria of Color Streaks A

G1: Color streaks with a length of 0.5 mm to 5 mm are not formed in the non-image portion, or there are less than 5 such sheets G2: There are 5 sheets or more to less than 10 sheets where color streaks with a length of 0.5 mm to 5 mm are formed in the non-image portion G3: There are more than 10 sheets where color streaks with a length of 0.5 mm to 5 mm are formed in the non-image portion Evaluation Criteria of Color Streaks B G1: Color streaks with a length of 10 mm or more are not formed in the non-image portion, or there are less than such 5 sheets G2: There are 5 sheets or more to less than 10 sheets where color streaks with a length of 10 mm or more are formed in the non-image portion G3: There are more than 10 sheets where color streaks with a length of 10 mm are formed in the non-image portion Toner Scattering G1: Toner scattering is not occurred in the image portion G2: There are 1 sheet to 10 sheets where toner scattering is occurred in the image portion G3: There are more than 10 sheets are toner scattering is occurred in the image portion

TABLE 2

| | Toner | | | | | | | | | | | | | Ratio | Ratio of | | | |
|---|---|---|---|---|---|---|---|---|---|---|---|---|---|---|---|---|---|---|
| | | Fatty acid metal salt particles | | | | | | | Peak particle diameter of polishing | | | | | of fatty acid metal | strongly attached fatty | | | |
| | | | | NOBIRUTA stirring conditions | | | Polishing agent | | agent particles and | | | Diameter of toner | | salt-attached | acid metal | | | |
| | Toner | | | | Rota- | Stir- | particles | | fatty acid | | | particles | | toner | salt | | | |
| | Par- | | No. | Clear- | tion | ring | | No. | metal salt | | | [μm] | | particles | particles | Color | Toner | Color |
| | ticles | | of | ance | speed | time | | of | particles [μm] | | | | 0.5 X | (% by | (% by | streaks | scat- | streaks |
| | Type | Type | parts | (mm) | (rpm) | (min) | Type | parts | Da | Db | Dc | Dt | Dt | number) | number) | A | tering | B |
| Example 1 | 1 | FM1 | 0.3 | 2 | 3000 | 10 | Ab1 | 0.3 | 0.12 | 3.5 | 0.6 | 3.2 | 1.6 | 55 | 70 | G1 | G2 | G1 |
| Example 2 | 1 | FM1 | 0.3 | 2 | 3000 | 10 | Ab5 | 0.3 | 1.5 | 3.5 | 0.6 | 3.2 | 1.6 | 55 | 70 | G1 | G2 | G1 |
| Example 3 | 1 | FM2 | 0.3 | 2 | 3000 | 10 | Ab1 | 0.3 | 0.12 | 3.5 | 1.5 | 3.2 | 1.6 | 42 | 58 | G2 | G1 | G1 |
| Example 4 | 1 | FM2 | 0.3 | 2 | 3000 | 10 | Ab5 | 0.3 | 1.5 | 3.5 | 1.5 | 3.2 | 1.6 | 42 | 58 | G2 | G2 | G1 |
| Example 5 | 2 | FM1 | 0.3 | 2 | 3000 | 10 | Ab9 | 0.3 | 4.6 | 10 | 0.6 | 9.6 | 4.8 | 65 | 75 | G1 | G2 | G2 |
| Example 6 | 2 | FM1 | 0.3 | 2 | 3000 | 10 | Ab10 | 0.3 | 4.6 | 18 | 0.6 | 9.6 | 4.8 | 65 | 75 | G1 | G2 | G1 |
| Example 7 | 2 | FM1 | 0.3 | 2 | 3000 | 10 | Ab2 | 0.3 | 0.12 | 10 | 0.6 | 9.6 | 4.8 | 65 | 75 | G1 | G1 | G2 |
| Example 8 | 2 | FM1 | 0.3 | 2 | 3000 | 10 | Ab3 | 0.3 | 0.12 | 18 | 0.6 | 9.6 | 4.8 | 65 | 75 | G1 | G1 | G1 |
| Example 9 | 2 | FM4 | 0.3 | 2 | 3000 | 10 | Ab9 | 0.3 | 4.6 | 10 | 4.2 | 9.6 | 4.8 | 36 | 58 | G2 | G2 | G2 |
| Example 10 | 2 | FM4 | 0.3 | 2 | 3000 | 10 | Ab10 | 0.3 | 4.6 | 18 | 4.2 | 9.6 | 4.8 | 36 | 58 | G2 | G2 | G1 |
| Example 11 | 2 | FM4 | 0.3 | 2 | 3000 | 10 | Ab2 | 0.3 | 0.12 | 10 | 4.2 | 9.6 | 4.8 | 36 | 58 | G2 | G1 | G2 |
| Example 12 | 2 | FM4 | 0.3 | 2 | 3000 | 10 | Ab3 | 0.3 | 0.12 | 18 | 4.2 | 9.6 | 4.8 | 36 | 58 | G2 | G1 | G1 |
| Example 13 | 1 | FM6 | 0.3 | 2 | 3000 | 10 | Ab12 | 0.3 | 0.2 | 4 | 1 | 3.2 | 1.6 | 53 | 68 | G1 | G1 | G2 |
| Example 14 | 3 | FM1 | 0.3 | 2 | 3000 | 10 | Ab1 | 0.3 | 0.12 | 3.5 | 0.6 | 3.5 | 1.8 | 51 | 73 | G2 | G2 | G1 |
| Comparative Example 1 | 1 | FM1 | 0.3 | 2 | 3000 | 10 | Ab4 | 0.3 | 1.5 | 3 | 0.6 | 3.2 | 1.6 | 55 | 70 | G1 | G2 | G3 |
| Comparative Example 2 | 1 | FM1 | 0.3 | 2 | 3000 | 10 | Ab7 | 0.3 | 2 | 18 | 0.6 | 3.2 | 1.6 | 55 | 70 | G1 | G3 | G1 |
| Comparative Example 3 | 1 | FM3 | 0.3 | 2 | 3000 | 10 | Ab5 | 0.3 | 1.5 | 3.5 | 2 | 3.2 | 1.6 | 34 | 53 | G3 | G2 | G2 |
| Comparative Example 4 | 2 | FM4 | 0.3 | 2 | 3000 | 10 | Ab11 | 0.3 | 5 | 10 | 4.2 | 9.6 | 4.8 | 36 | 58 | G2 | G3 | G2 |
| Comparative Example 5 | 2 | FM4 | 0.3 | 2 | 3000 | 10 | Ab8 | 0.3 | 4.6 | 8 | 4.2 | 9.6 | 4.8 | 36 | 58 | G2 | G2 | G3 |
| Comparative Example 6 | 2 | FM5 | 0.3 | 2 | 3000 | 10 | Ab9 | 0.3 | 4.6 | 10 | 5.5 | 9.6 | 4.8 | 36 | 58 | G3 | G2 | G2 |
| Comparative Example 7 | 3 | FM1 | 0.3 | 2 | 3000 | 10 | Ab4 | 0.3 | 1.5 | 3 | 0.6 | 3.5 | 1.8 | 57 | 62 | G1 | G1 | G3 |

From the above results, it is understood that, in comparison with the comparative examples, the present example obtained favorable results for the toner scattering and the color streaks B due to wear in the intermediate transfer member.

In addition, in the present example, it is also understood that favorable results are also obtained for the color streaks A due to toner slipping from the intermediate transfer member cleaning portion.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles;

polishing agent particles which have a number particle size distribution having two peaks; and fatty acid metal salt particles which have a number particle size distribution having one peak;

wherein the toner satisfies relationships expressed by Expressions (1) to (3) below:

$$Da \leq 0.5 \times Dt \quad (1)$$

$$Dc \leq 0.5 \times Dt \quad (2)$$

$$Dt \leq Db \quad (3)$$

wherein Da represents a particle diameter of a small-diameter-side peak in the two peaks of the number particle size distribution of the polishing agent particles, Db represents a particle diameter of a large-diameter-side peak in the two peaks of the number particle size distribution of the polishing agent particles, Dc represents a particle diameter of a peak of the number particle size distribution of the fatty acid metal salt particles, and Dt represents a volume average particle diameter of the toner particles.

2. The electrostatic charge image developing toner according to claim 1, wherein the particle diameter Da of the small-diameter-side peak of the polishing agent particles is from 0.3 μm to 4.0 μm, the particle diameter Db of the large-diameter-side peak of the polishing agent particles is from 4.0 μm to 20 μm, the particle diameter Dc of the peak of the fatty acid metal salt particles is from 0.1 μm to 5.0 μm, and the volume average particle diameter Dt of the toner particles is from 3.0 μm to 10.0 μm.

3. The electrostatic charge image developing toner according to claim 1, wherein the toner particles have a recess on a surface thereof.

4. The electrostatic charge image developing toner according to claim 3, wherein a shrinkage ratio of the toner particles is in a range from 2.0% to 40%.

5. The electrostatic charge image developing toner according to claim 1, wherein a ratio of toner particles having the fatty acid metal salt particles attached on a surface thereof is 30% by number to 90% by number with respect to a total of the toner particles, and the ratio of the fatty acid metal salt particles which are strongly attached on the surface of the toner particles is 50% by number or more with respect to the fatty acid metal salt particles attached on the surface of the toner particles.

6. The electrostatic charge image developing toner according to claim 1, wherein a weight ratio of the polishing agent particles to the fatty acid metal salt particles is from 1:40 to 20:1.

7. An electrostatic image developer comprising:

a carrier; and the electrostatic charge image developing toner according to claim 1.

8. A toner cartridge, comprising:

a container that contains the electrostatic charge image developing toner according to claim 1, wherein the toner cartridge is detachable from an image forming apparatus.

* * * * *